US007926231B2

(12) United States Patent
Laukhuf

(10) Patent No.: US 7,926,231 B2
(45) Date of Patent: Apr. 19, 2011

(54) APPARATUS AND METHOD OF ROUTING CABLING AROUND LEVELER LEGS IN A THIN MODULAR OFFICE PANEL

(75) Inventor: Gregg E. Laukhuf, Bryan, OH (US)

(73) Assignee: Group Dekko, Inc., Kendallville, IN (US)

( * ) Notice: Subject to any disclaimer, the term of this patent is extended or adjusted under 35 U.S.C. 154(b) by 1220 days.

(21) Appl. No.: 11/549,730

(22) Filed: Oct. 16, 2006

(65) Prior Publication Data

US 2007/0107335 A1 May 17, 2007

Related U.S. Application Data

(60) Provisional application No. 60/728,204, filed on Oct. 19, 2005, provisional application No. 60/775,167, filed on Feb. 21, 2006.

(51) Int. Cl.
*E04C 2/52* (2006.01)
*E04H 1/00* (2006.01)

(52) U.S. Cl. ..... 52/239; 52/220.7; 52/220.1; 52/220.8

(58) Field of Classification Search ..... 52/220.7, 52/239, 220.1, 220.8; 439/113, 121, 122, 439/207, 208, 209, 210, 211
See application file for complete search history.

(56) References Cited

U.S. PATENT DOCUMENTS 4,231,630 A 11/1980 Propst et al. ..... 339/22 R
4,270,020 A * 5/1981 Kenworthy et al. ..... 174/497
4,277,123 A 7/1981 Haworth et al. ..... 339/22 R
4,308,418 A 12/1981 Van Kuik et al. ..... 174/48
4,703,985 A 11/1987 Finkbeiner et al. ..... 439/207
4,713,918 A * 12/1987 Cioffi ..... 174/495
4,808,768 A * 2/1989 Sireci ..... 174/480
4,899,018 A 2/1990 Sireci
4,899,019 A 2/1990 Sireci ..... 174/48
4,918,886 A 4/1990 Benoit et al. ..... 52/221
5,091,607 A 2/1992 Stob ..... 174/48
5,096,433 A * 3/1992 Boundy ..... 439/215
5,252,086 A * 10/1993 Russell et al. ..... 439/215
5,277,609 A * 1/1994 Ondrejka ..... 439/215
5,381,994 A * 1/1995 Welch ..... 248/346.01
(Continued)

*Primary Examiner* — Richard E Chilcot, Jr.
*Assistant Examiner* — Mark R Wendell
(74) *Attorney, Agent, or Firm* — Taylor IP, PC

(57) ABSTRACT

A modular furniture component such as an electrified relatively thin panel has electrical wiring in a raceway near a downwardly depending adjustable leveler leg and a pluggable multiconductor cable for connecting the raceway electrical wiring with another modular furniture component. The components may each comprise a relatively thin upstanding generally rectangular modular office wall panel having an electrical wiring containing raceway near a bottom edge. Adjacent panels have the raceways generally horizontally aligned with one another. In one form, apparatus and method is disclosed for routing the power and data cables/conductors out of the bottom of the panels next to threaded leveler legs and back up into the adjacent panel. The cable is located closely adjacent a thinnest portion of the adjustable leveler leg and has a portion thereof displaced vertically below each raceway. The cables are enclosed in a removable device that clamshells around the legs with the clamshell located beneath a lowermost portion of the raceway for enclosing portions of the leveler leg and cable. The clamshell cable housings can be in a variety of shapes to accommodate any combination of panel intersections with straight, parallel, 90°, "T", cross or four-way, and 120° described. In another form, the panel support posts are modified to present a thin portion of leveler legs about which the cables may be routed in horizontal alignment with the raceways.

14 Claims, 6 Drawing Sheets

U.S. PATENT DOCUMENTS 5,595,495 A * 1/1997 Johnson et al. ..... 439/215
5,685,113 A * 11/1997 Reuter et al. ..... 52/220.7
5,728,970 A * 3/1998 Karst et al. ..... 174/497
5,901,512 A 5/1999 Bullwinkle ..... 52/220.7
6,036,516 A * 3/2000 Byrne ..... 439/215
6,218,612 B1 * 4/2001 McKitrick et al. ..... 174/495
6,235,988 B1 5/2001 Karst et al. ..... 174/48
6,329,591 B2 12/2001 Karst et al. ..... 174/48
6,350,135 B1 * 2/2002 Acklin et al. ..... 439/211
6,367,211 B1 * 4/2002 Weener et al. ..... 52/220.1
6,865,853 B2 * 3/2005 Burken et al. ..... 52/239
6,910,903 B2 * 6/2005 Kondas ..... 439/215
7,205,487 B1 * 4/2007 Plattner ..... 174/480
2002/0088188 A1 * 7/2002 Chang ..... 52/238.1
2006/0024996 A1 * 2/2006 Johnson et al. ..... 439/215

* cited by examiner

APPARATUS AND METHOD OF ROUTING CABLING AROUND LEVELER LEGS IN A THIN MODULAR OFFICE PANEL

CROSS REFERENCE TO RELATED APPLICATIONS

This is a non-provisional application based upon U.S. provisional patent application Ser. No. 60/728,204, entitled "APPARATUS AND METHOD OF ROUTING CABLING AROUND LEVELER LEGS IN A THIN MODULAR OFFICE PANEL", filed Oct. 19, 2005, and based upon U.S. provisional patent application Ser. No. 60/775,167, entitled "APPARATUS AND METHOD FOR ROUTING CABLING IN A THIN MODULAR OFFICE PANEL", filed Feb. 21, 2006.

BACKGROUND OF THE INVENTION

1. Field of the Invention

The present invention relates to power distribution systems, and, more particularly, to a technique for electrically interconnecting prewired movable wall panels and other modular furniture.

2. Description of the Related Art

Modular wall panels have been used for a number of years to divide a relatively large open space into smaller cubicles or workspaces and have the advantage of being comparatively easily rearranged. Electrification of those wall panels was one of the early improvements. Many techniques for power or communications wiring in modular furniture are known. Wall panels and other modular components may have raceways for enclosing the wiring which may be installed on site as the panels are being assembled, or which may be factory installed to be later interconnected by panel-to-panel interconnects or jumpers. Commonly, the wiring receiving raceways are located along panel extremities, frequently along a lower panel edge. Wall panels typically include a pair of leveler legs, one near each end of the lower panel edge, for panel support. When panels which are prewired, for example by multiconductor cables disposed in an integral raceway also located near the lower panel edge, the interconnection between the panels must contend with the leveler legs. In the past, this has presented little problem. Modular office or work panel partition manufacturers are introducing new thin panel product lines, typically around only one inch thick. Thin panels do not make any provision for the routing of power and/or data cables from one panel to the next.

The Van Kuik et al U.S. Pat. No. 4,308,418 recognized that in hard wiring movable room divider panels, it was particularly difficult to run fairly large conduit, such as one-half inch diameter conduit through or around the vertical support posts and/or foot portions of freestanding partitions of the type having a supporting leg depending from the partition bottom edge at each end of the panel. The patentees proceed to solve this problem by replacing conventional conduit with a relatively flat split-body protective shell. This patent did not address prewired panels. The relationship between panel leveler legs and wiring has also been addressed in the Propst et al U.S. Pat. No. 4,231,630. This patent seeks to avoid the cost of prewired panels by providing a rigid power distribution system of interconnectable raceway units which mount beneath conventional wall panels. Each raceway section has a pair of semi-cylindrical upright openings 74 which are contoured to fit around threaded adjustment leg shafts spaced from one another by a distance equal to the leveler leg separation. Thus, the raceways are specifically designed to fit a particular panel configuration. This patent is not concerned with thin panels and does not employ panel-to-panel jumper technology.

As the modular furniture industry has gone to thinner and thinner room divider panels, the problem early recognized by Van Kuik et al has become more and more acute, particularly in prewired panel applications. Sacrificing height for thickness, as suggested by Van Kuik et al, or employing a rigid connection somewhat like that shown in Propst et al have not, to date, provided an adequate solution.

What is needed in the art is a panel-to-panel interconnection technique particularly suited to a thin panel environment and adapted to a variety of panel configurations.

SUMMARY OF THE INVENTION

The present invention provides a removable jumper cable assembly to couple adjacent panel wiring and a portion of the cable, as well as a portion of the leveler leg, is enclosed by a cover or shroud. In one form, the jumper cable is routed downwardly from the panel raceway, then around the thinnest (threaded) portion of a leveler leg, hence back upwardly into line with the raceway wiring. In another form, the leveler leg threaded portion extends upwardly sufficiently far to allow routing of the jumper cable about that thinnest part without diverting the cable down and then back up. Several shroud configurations and several jumper cable assembly configurations, each suited to the particular number and nature of adjoining panels, are disclosed. The "clamshell" cable housings of the present invention are designed to be as close as possible to the same width as the panel (or thinner) so they do not encroach on any useable space under the work surfaces. Further, the "clamshell" cable housings of the present invention are also as short as possible to minimize the distance the leveler legs of the modular wall panel need to be turned out.

The invention comprises, in one form thereof a method of and apparatus for rerouting electrical cabling around adjustable length leveler legs in thin office panels by coupling wiring in each of two office panels with a jumper cable assembly, locating a leveler leg region of minimal lateral dimension vertically below and closely adjacent a panel lower edge, and utilizing the available space surrounding the located region of the leveler leg to route the jumper cable assembly between the panels. A portion of both the assembly cable and the located region of the leg are then enclosed within a cover. The office panel wiring is typically disposed in generally horizontally extending raceways located near respective bottom edges of the panels. The located leveler leg region may extend from within the panel and in general horizontal alignment with the panel wiring raceways downwardly beyond the respective panel lower edges, or may lie entirely beneath the panel lower edge.

Also in general and in one form of the invention, an electrified modular wall panel system includes at least two relatively thin upstanding generally rectangular modular office wall panels, each having an electrical wiring containing raceway near a bottom edge thereof, and a pair of adjustable leveler legs extending from the panel bottom edge, one near each end of each panel bottom edge. A removable jumper cable assembly electrically couples the wiring in one panel raceway with the wiring in the other panel raceway, and a shroud encloses a central portion of the jumper cable assembly and a relatively thin adjustable length portion of one leveler leg of each panel. The panel raceways are generally horizontally aligned with one another and the central portion of the jumper may be vertically displace below the raceways, or the thin leveler leg adjustable length portion may extend upwardly into the region between adjacent raceways.

An advantage of the present invention is electrical interconnection of wiring in thin wall panels which lies entirely within the lateral extent of the thin wall panels.

Another advantage of the present invention is that it provides an apparatus and method to route cables (including jumper cables) from one panel to the next when no provision is otherwise available.

A further advantage of the present invention is an unobtrusive cable coupling between thin wall panes that does not interfere with roll away file cabinets, and such, underneath the work surfaces.

Yet another advantage is the jumper assembly is suited to a variety of specific panel leveler leg configurations.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
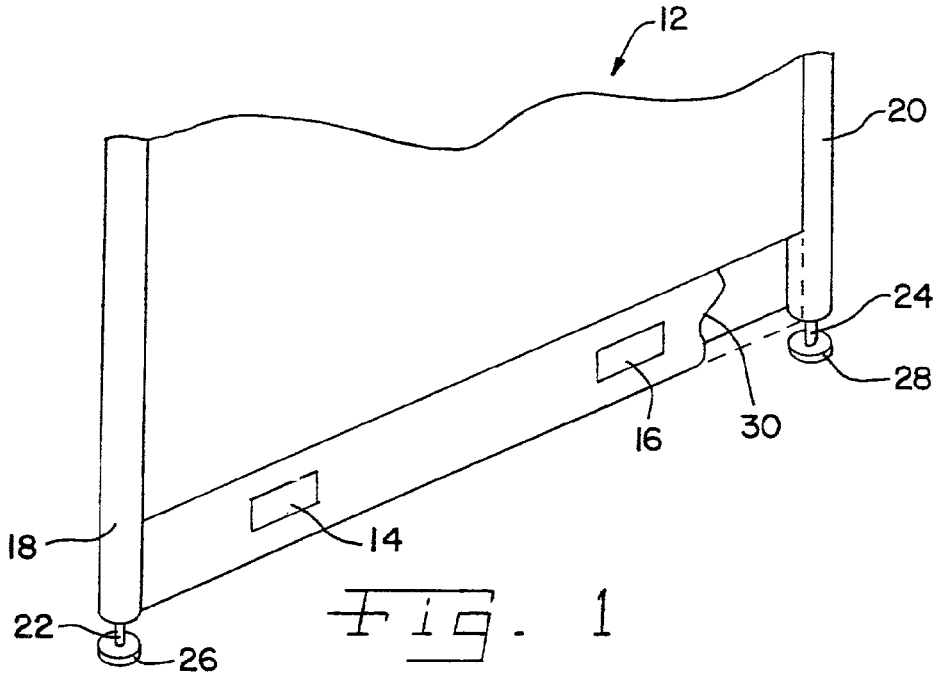
FIG. 1 is an isometric view of a portion of a thin modular wall panel partially cut away to reveal the relationship between the raceway and leveler leg.

Referring now to the drawings, and more particularly to FIG. 1, there is shown a single thin room divider or modular wall panel 12 having a raceway 30 for receiving electrical wiring near a panel bottom edge. There are knockout segments 14 and 16 for receiving electrical receptacles and vertical tubular panel support posts 18 and 20 near the panel edges. The support posts 18 and 20 include thin adjustable length leveler leg portions such as the threaded studs 22, and 24 extending from the panels near their opposite ends which terminate at feet or pads 26 and 28 designed to rest on a floor. The raceway 30 extends between the posts 18 and 20 which block direct access to adjacent panels.

Figure 2:
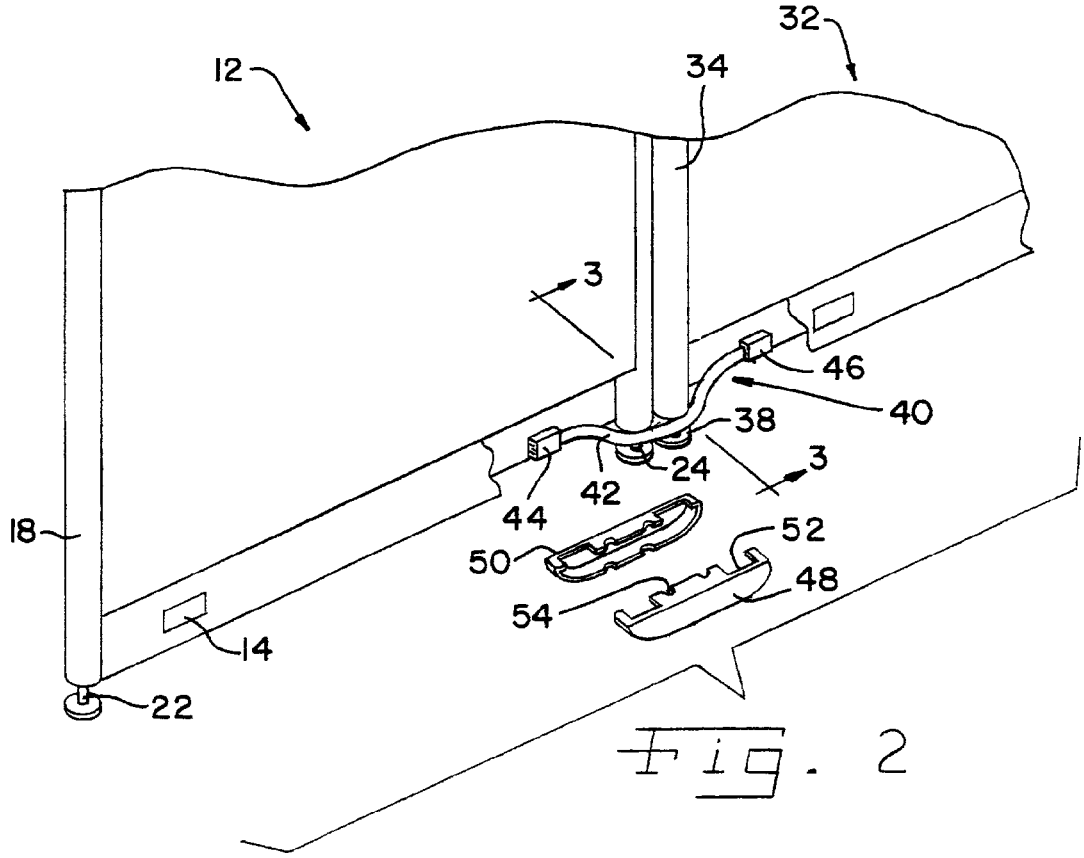
FIG. 2 is an isometric view similar to FIG. 1, but showing the interconnection of two wall panels with a two-piece cable housing exploded from the assembly according to the present invention.
Figure 3:
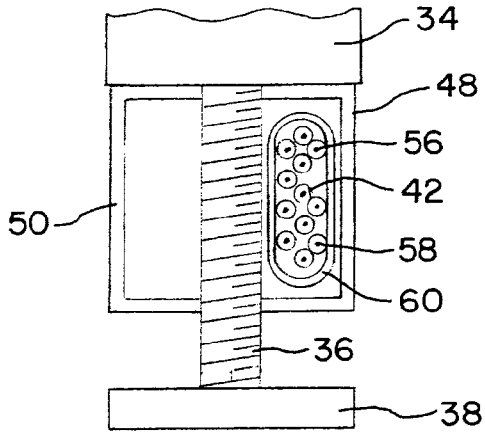
FIG. 3 is a cross-sectional view along lines 3-3 of FIG. 2.
Figure 6:
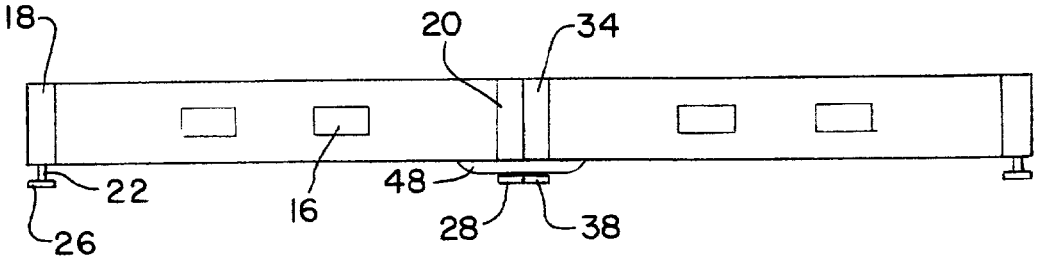
FIG. 6 is a side elevation view of two thin modular wall panel raceways joined at a straight angle and showing the cable housing according to the present invention.

In FIG. 2, there is shown a second wall panel 32 juxtaposed with panel 12 which generally includes another support post 34 having a threaded leveler shaft 36 (FIG. 3) supported on pad 38. A jumper cable assembly 40 having a multiconductor cable 42 terminating at connectors 44 and 46 is employed to electrically couple the raceway wiring in the juxtaposed panels. When the cable 42 is properly located along side of the narrow threaded portion 36, the shroud portions 48 and 50 are joined enclosing both the cable portion and a portion of the leveler leg as illustrated in FIGS. 3 and 6. The shroud portions 48 and 50 are essentially identical, each including a pair of notches such as 52 which, when the shroud halves are joined in position, encircle the cable 42, and four notches such as 54 which, when the shroud halves are joined in position, encircle the leveler legs both above the cable and beneath the cable. The cable 42 may be of any suitable type and is illustrated as including multiple conductors such as 56 and 58 enclosed in a protective sheath such as flexible mesh jacket 60.

As seen in FIG. 3, the horizontal thickness of the shroud 48, 50 and enclosed jumper 42 and leg portion 36 is not greater than, but may be less than the horizontal thickness of the post 34 and raceway portion of panel 32. The leveler legs include the foot or pad 38, generally cylindrical externally threaded portion 36 and a threaded bushing or other thread receiving aperture in post 34 and these constitute regions of various horizontal thicknesses. The shroud 48, 50 partially encloses some of the threaded portion which is a region of minimal horizontal thickness of each leg.

Figure 4:
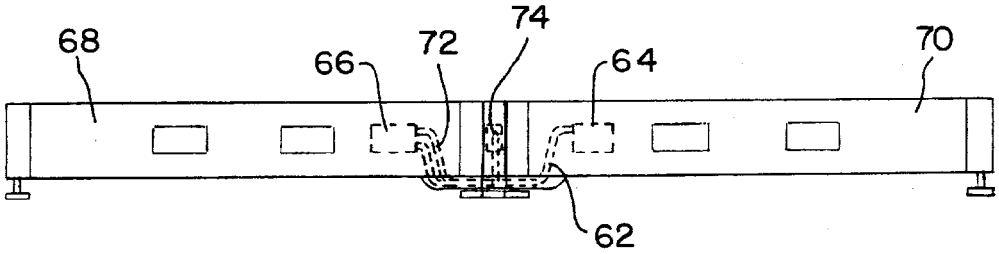
FIG. 4 is a side elevation view of four thin modular wall panel raceways joined at a common corner, showing the electrical cables and the cable housings according to the present invention.
Figure 5:
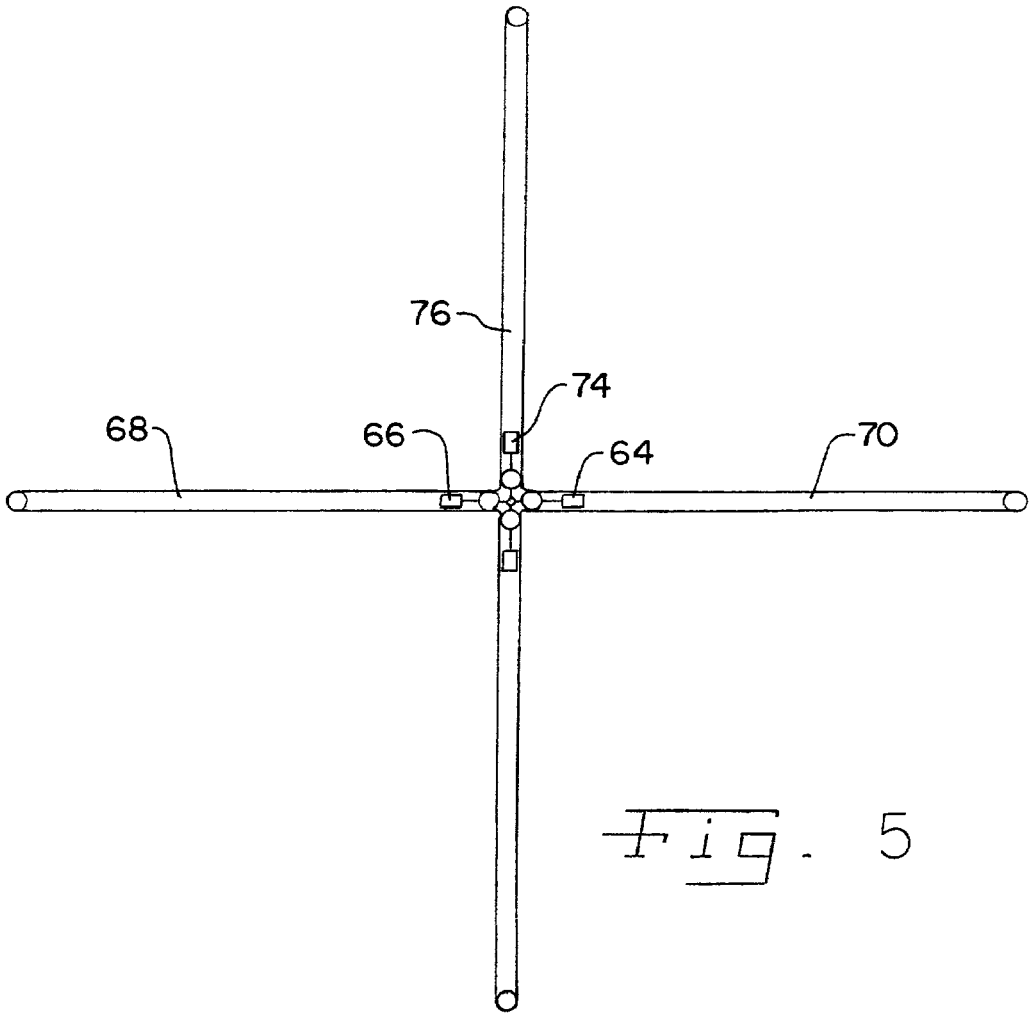
FIG. 5 is a top plan view of the four thin modular wall panel raceway configuration of FIG. 4.

FIGS. 4 and 5 are side elevation and top plan views respectively of raceway and leveler leg portions of four panels meeting at a corner. A jumper cable assembly including cable 62, and connectors 64 and 74 couple the wiring in raceways 70 and 76. The system includes two further jumper cable assemblies. One has cable 72 extending from connector 66 to a connector 74 in raceway 76. Connector 74 is shared by two cables, 62 and 72. The four connectors may be identical. Connector 66 has a further cable for connecting with a connector and wiring in the fourth raceway. Each jumper cable assembly electrically couples the wiring in a distinct pair of orthogonally disposed panel raceways in the manner illustrated in FIG. 14.

Figure 7:
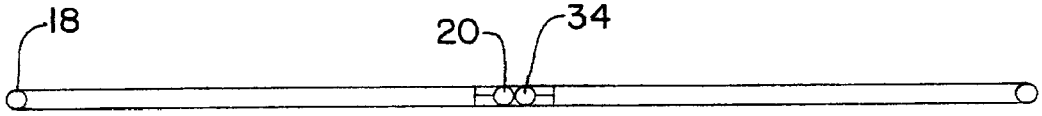
FIG. 7 is a top plan view of the two thin modular wall panel raceway arrangement of FIG. 6.

FIGS. 6 and 7 are side elevation and top plan views respectively of raceway and leveler leg portions of two panels meeting at a straight angle. The jumper cable assembly is not shown in FIGS. 6 and 7.

Figure 8:
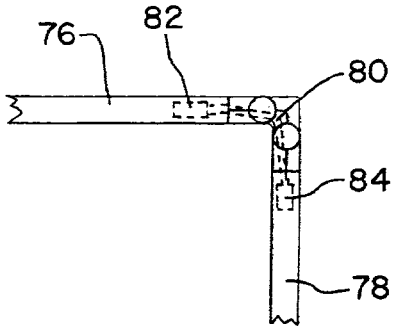
FIG. 8 is a top plan view of two thin modular wall panel raceways similar to FIG. 7, but joined at a right angle and showing the electrical cables.

FIG. 8 is a top plan view similar to FIG. 7, however, the wall panel raceways 76 and 78 are shown joined at a right angle, that is, they are positioned in quadrature with one another. The shroud comprises a pair of matable generally "L" shaped shroud portions. The shroud or cover portions differ in that one half may be much the same as the clamshell portions shown in FIG. 11 with the notches opening outwardly of the "L", while the other is slightly longer and has matching notches facing inwardly of the "L." A jumper cable assembly which interconnects the race wiring includes cable 80 terminated at connectors 82 and 84.

Figure 9:
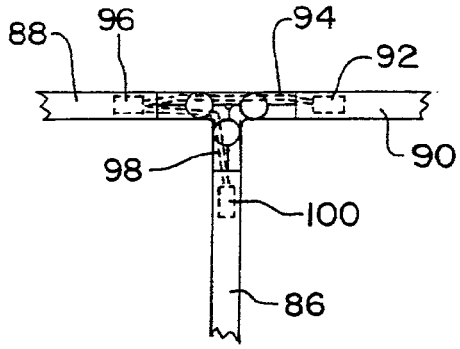
FIG. 9 is a top plan view of three thin modular wall panel raceways joined at a common corner and showing the electrical cables.

FIG. 9 illustrates three wall panels joined orthogonally at a corner. There are three panels with panel raceway 86 shown extending at a generally right angle to an adjacent pair of panel raceways 88 and 90. A connector 92 is coupled by cable 94 to connector 96. Connector 96 has a second cable 98 extending therefrom to connector 100. There are two jumper cable assemblies which share the connector 96 and each jumper cable assembly electrically couples the wiring in a distinct pair of panel raceways. For this configuration, the shroud may comprise two generally "L" shaped shroud portions of the style shown in FIG. 11 having matable respective first legs and a generally linear shroud portion of the style shown in FIG. 2 including halves each of which is matable with a respective "L" shaped shroud portion second leg. As before, the shroud encloses a central portion of each of the two assembly cables and a relatively thin adjustable length portion of one leveler leg of each of the three panels.

Figure 10:
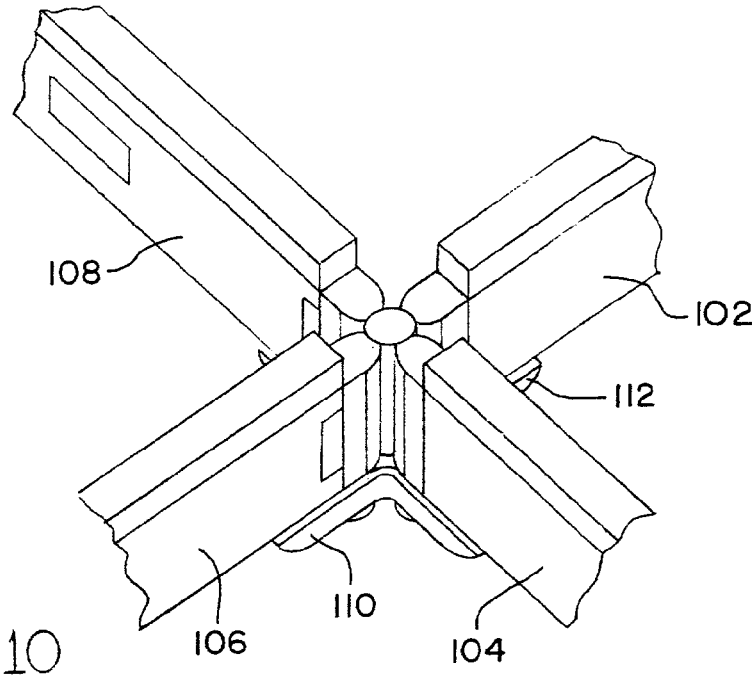
FIG. 10 is an isometric fragmentary view of a thin modular wall panel raceway cross combination.
Figure 11:
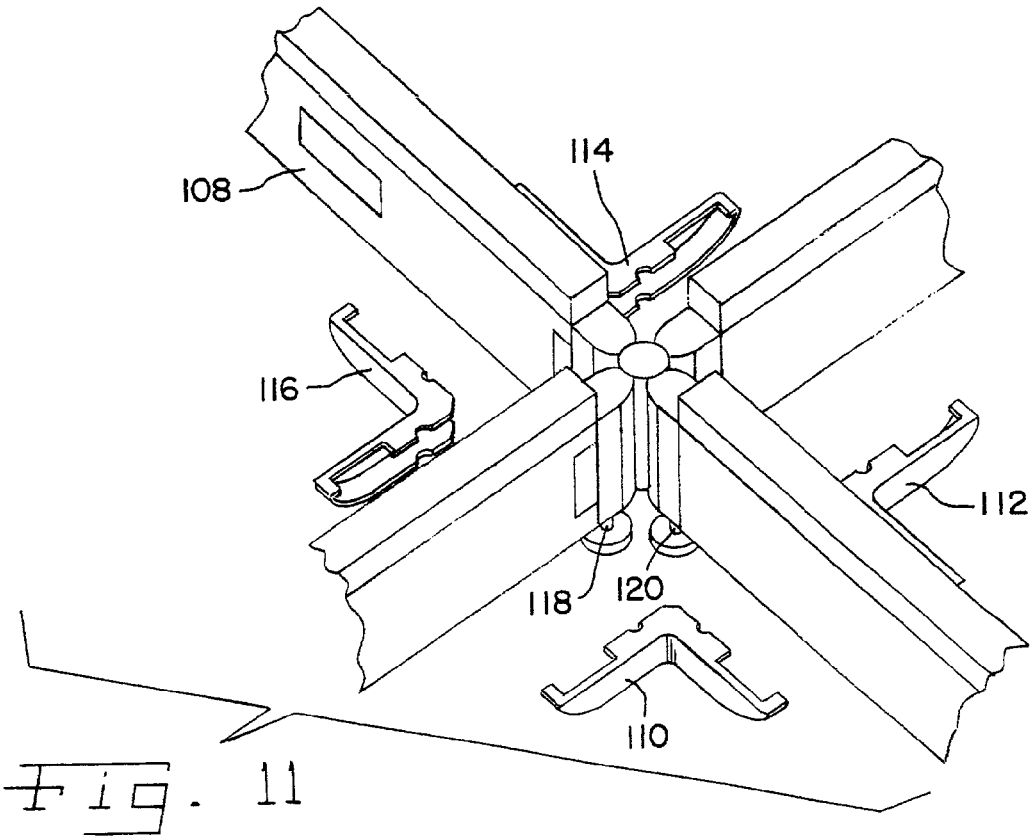
FIG. 11 is an exploded fragmentary view of the raceway cross combination of FIG. 10 with the "clamshell" cable housings exploded therefrom.

FIGS. 10 and 11 show portions of four raceways 102, 104, 106 and 108 joined orthogonally as in FIGS. 4 and 5. Thus, there would be four panels, each extending at a generally right angle to an adjacent pair of panels. As seen in FIG. 4, the system may include three jumper cable assemblies with each jumper cable assembly electrically coupling the wiring in a distinct pair of orthogonally disposed panel raceways although other wiring patterns may be employed. The shroud comprises four like matable generally "L" shaped portions 110, 112, 114, and 116 which, when joined as in FIG. 10 enclose a central portion of each of the three assembly cables such as 62 and 72 in FIG. 4, and a relatively thin adjustable length portion such as 118 or 120 of one leveler leg of each of the four panels.

Generally, there will be the same number of wall panels, connectors and shroud or cover portions. One or more connectors will be shared resulting in one less jumper cable assembly than there are panels. In general, there are a plurality of n+1 relatively thin upstanding generally rectangular modular office wall panels, each having an electrical wiring containing raceway near a bottom edge thereof. The removable jumper cable assembly includes n multiconductor cables terminating in n+1 cable end connectors n−1 of which accommodate two cables and two of which accommodate a single cable. Each cable end connector is adapted to electrically connect with the electrical wiring of a panel for electrically coupling the wiring in one panel raceway with the wiring in each of the other panel raceways. The n+1 matable cover portions will be nearly identical only when n is an odd number, however, they may be nearly identical in other cases such as in a radial deployment of an odd number of panels.

Figure 12:
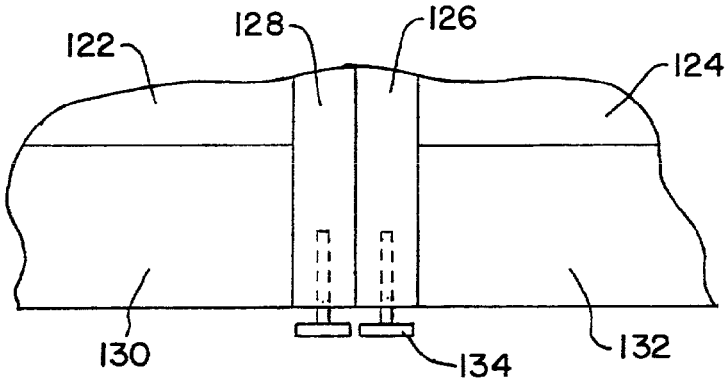
FIG. 12 is a fragmentary side elevation view of two prior art adjacent thin modular wall panels.
Figure 13:
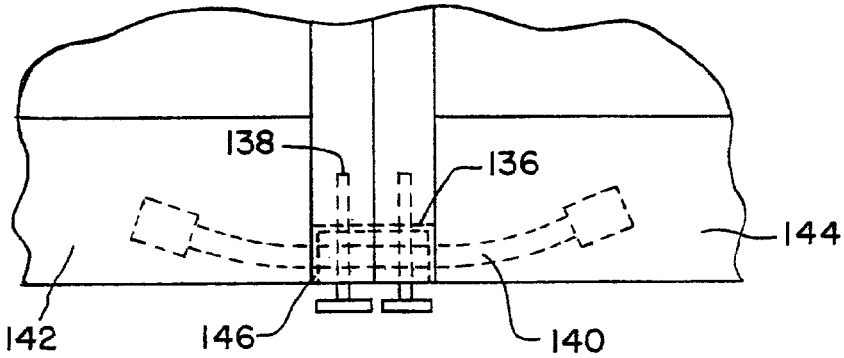
FIG. 13 is a fragmentary side elevation view of the two adjacent thin modular wall panels of FIG. 12 modified according to one form of the present invention.

The junction of two panel portions 122 and 124 in FIG. 12 shows the problem of the posts 126 and 128 blocking access between raceways 130 and 132. In some cases the separation between the bottom edge of raceway 132 and the foot or leveler pad 134 may be inadequate to accommodate a jumper cable and shroud. FIG. 13 addresses this problem in a somewhat different way. By shortening the posts 126 and 128 so their bottom ends are at the level indicated at 136, and lengthening the threaded shafts of the leveler legs to locate the upper ends at the level indicated at 138, the leveler leg region of minimal lateral dimension is effectively extended or moved up to from that shown in FIG. 12 to the position shown in FIG. 13 providing space for the jumper cable 140 to pass without deviating below the lowermost portion of the raceways 142 and 144. The gap between the lowermost portion of the raceways and the floor remains the same as in FIG. 12. A cap 146 similar to the previously discussed shrouds may cover the exposed leveler leg portions where the mesh jumper cable 140 passes between panels.

Figure 14:
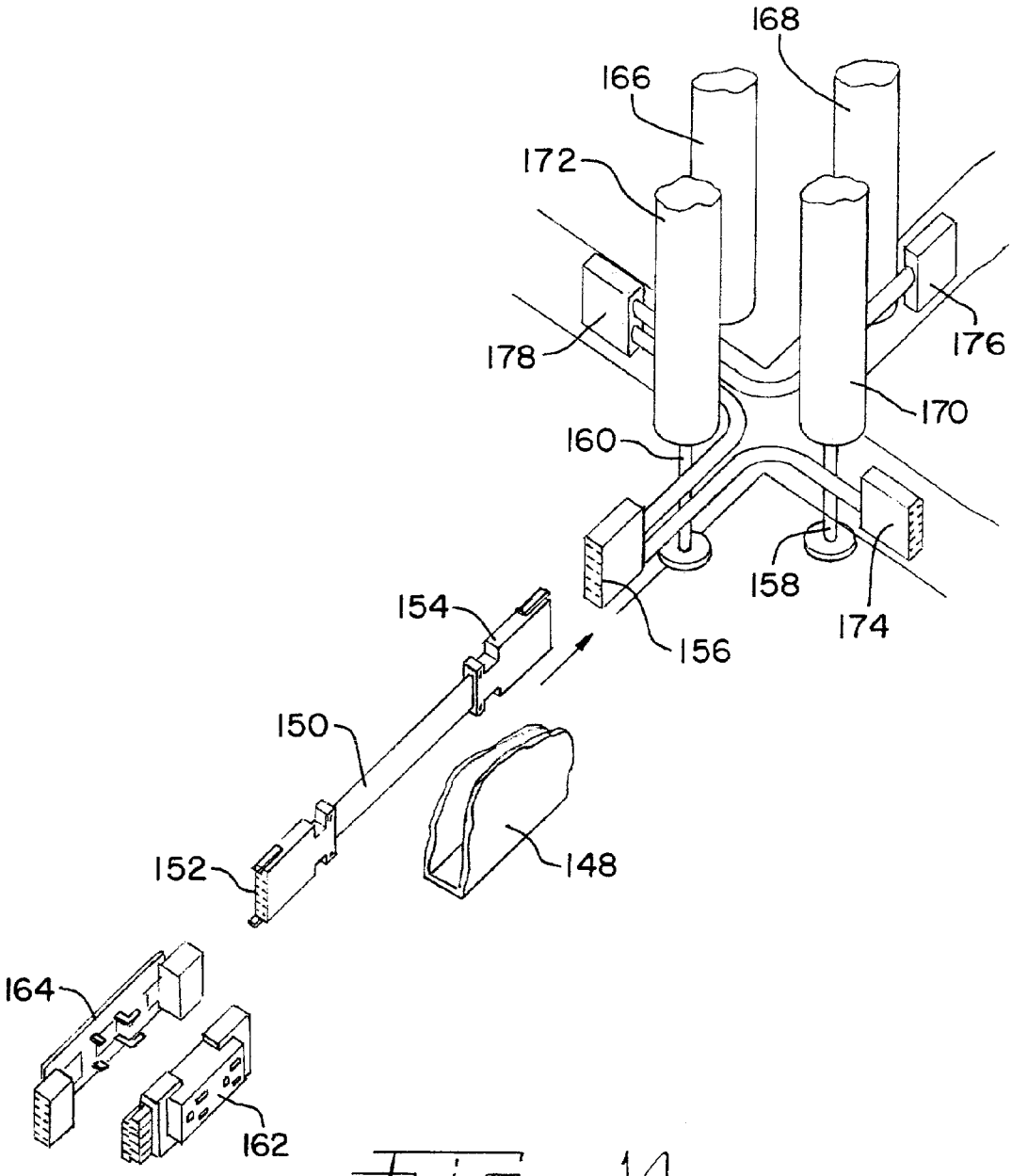
FIG. 14 is an exploded fragmentary view of a raceway cross combination with raceway electrical components exploded therefrom to be connected by the technique of FIG. 13.

FIG. 14 shows a technique for interconnecting a panel configuration like that of FIGS. 4, 5, 10 and 11 employing the techniques taught in FIG. 13. In FIG. 14, a broken-away portion of a raceway 148 is shown for receiving a flexible cable 150 and connectors 152 and 154 for coupling the cable 150 to connector 156 of the array of jumper assemblies nested about leveler leg threaded portions such as 158 and 160. The raceway wiring includes an electrical receptacle or duplex 162, of a type for which the knockouts 14 and 16 (FIGS. 1 and 6) were provided, to be received in distribution 164 to which the connector 152 provides power. In FIG. 14 there are four support posts 166, 168, 170 and 172 associated with four orthogonally meeting panels which are electrically coupled by four connectors 156, 174, 176 and 178 interconnected by three jumper cables. Four suitable "L" shaped covers somewhat like those of FIG. 11, but aligned with the raceways as in FIG. 13 may be provided to obscure and protect the jumper assemblies.

The clamshell or cover of FIGS. 2, 3, 6 and 7 is formed of a pair of like halves each having a symmetrically disposed set of notches which, when the halves are closed on one another, encircle the legs as well as entering and exiting cable portions. The halves are nearly identical, but may differ from one another by having matable latching pawls or similar mechanisms, or a myriad of other joining techniques may be employed, such as threaded fasteners, solvent, heat or adhesive bonding, spring clips, or other common coupling techniques. Except for the possible exception of joining features, the clamshell or housing portions of FIGS. 2-7, 10 and 11 may be identical. The two cover halves in FIG. 8 are both "L" shaped, but differ in that one half may be much the same as the clamshell portions shown in FIG. 11 with the notches opening inwardly of the "L", while the other has matching notches facing outwardly of the "L." Two of the three cover portions in FIG. 9 may be identical, for example like those shown in FIG. 11 while the third may be linear, for example, like those shown in FIG. 2. Of course, identical cover portions for a three wall panel junction (or other odd number of panels) would suit an equiangularly spaced panel array.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

PARTS LIST

12, 32, 122, 124 thin modular wall panel
14, 16 receptackle knockouts
18, 20, 34, 126, 128, 166, 168, 170, 172 tubular support posts
22, 24, 36, 118, 120, 158, 160 thin adjustable length lever leg portion, threaded stud or shaft
26, 28, 38, 134 foot or pad
30, 68, 70, 76, 78, 86, 88, 90, 102, 104, 106, 108, 148 raceway
40 jumper cable assembly
42, 62, 72, 80, 94, 98, 140 multicolor cable

44, 46, 64, 66, 74, 82, 84, 92, 96, 100, 156, 174, 176, 178 connectors
48, 50, 110, 112, 114, 116, 146 shroud portions, cover or housing
52 conductor notch
54 leveler leg notch
56, 58 cable conductors
60 cable jacket or sheath
136 support post lower end
138 threaded stud upper end
150 raceway flexible cable
152, 154 raceway cable connectors
162 electrical receptacle or duplex
164 distribution

What is claimed is:

1. An electrified modular wall panel system, comprising:

at least two relatively thin upstanding generally rectangular modular office wall panels, each having an electrical wiring containing raceway near a bottom edge thereof, and a pair of adjustable leveler legs extending from the panel bottom edge, one near each end of each panel bottom edge;

a removable jumper cable assembly for electrically coupling the wiring in one panel raceway with the wiring in the other panel raceway; and a shroud for enclosing a central portion of the jumper cable assembly and a relatively thin adjustable length portion of one leveler leg of each panel, wherein the shroud comprises two substantallly identical portions each having a first set of notches which, when the portions are joined, encircle respective legs, and a second set of notches which, when the portions are joined, provide passageways for the assembly cable to pass between the raceway and the shroud.

2. The system of claim 1, wherein the panel raceways are generally horizontally aligned with one another and the central portion of the jumper is vertically displaced below the raceways.

3. The system of claim 2, wherein the panels are positioned in quadrature with one another and the shroud comprises a pair of matable generally "L" shaped shroud portions.

4. The system of claim 1, wherein the horizontal thickness of the shroud and enclosed jumper and leg portion is not greater than the horizontal thickness of each panel.

5. The system of claim 1, wherein there are four panels, each having an electrical wiring containing raceway near a bottom edge thereof and each extending at a generally right angle to an adjacent pair of panels, the system including two further jumper cable assemblies, each jumper cable assembly electrically coupling the wiring in a distinct pair of orthogonally disposed panel raceways.

6. The system of claim 5, wherein the shroud encloses a central portion of each of the three assembly cables and a relatively thin adjustable length portion of one leveler leg of each of the four panels.

7. The system of claim 6, wherein the shroud comprises four matable generally "L" shaped shroud portions.

8. The system of claim 1, wherein the leveler legs have regions of various horizontal thicknesses and the shroud partially encloses regions of minimal horizontal thickness of each leg.

9. The system of claim 8, wherein the regions of minimal horizontal thickness comprise generally cylindrical externally threaded regions.

10. The system of claim 1, wherein there are three panels, one extending at a generally right angle to an adjacent pair of panels, the system including one further jumper cable assembly, each jumper cable assembly electrically coupling the wiring in a distinct pair of panel raceways.

11. The system of claim 10, wherein the shroud encloses a central portion of each of the two assembly cables and a relatively thin adjustable length portion of one leveler leg of each of the three panels.

12. The system of claim 10, wherein the shroud comprises two generally "L" shaped shroud portions having matable respective first legs and a generally linear shroud portion including halves each matable with a respective "L" shaped shroud portion second leg.

13. The system of claim 1, wherein there are a plurality of n+1 relatively thin upstanding generally rectangular modular office wall panels, each having an electrical wiring containing raceway near a bottom edge thereof, the removable jumper cable assembly including n multiconductor cables terminating in n+1 cable end connectors n−1 of which accommodate two cables and two of which accommodate a single cable, each cable end connector adapted to electrically connect with the electrical wiring of a panel raceway for electrically coupling the wiring in one panel raceway with the wiring in each of the other panel raceways.

14. The system of claim 13, wherein there are n+1 panels and the cover comprises n+1 matable cover portions, the cover portions being nearly identical only when n is an odd number.

* * * * *